US005228694A

United States Patent [19]

Okumoto et al.

[11] Patent Number: 5,228,694

[45] Date of Patent: Jul. 20, 1993

[54] IRON GOLF CLUB HEAD MADE OF FIBER-REINFORCED RESIN

[75] Inventors: Takaharu Okumoto, Chigasaki; Toshio Ninomiya, Isehara; Tetsuo Hayashi; Kazuo Kawada, both of Hiratsuka, all of Japan

[73] Assignee: The Yokohama Rubber Co., Ltd., Tokyo, Japan

[21] Appl. No.: 843,229

[22] Filed: Feb. 28, 1992

Related U.S. Application Data

[63] Continuation-in-part of Ser. No. 571,146, Aug. 23, 1990, abandoned.

[30] Foreign Application Priority Data

Sep. 11, 1989 [JP] Japan ..... 1-105390
Sep. 11, 1989 [JP] Japan ..... 1-105391

[51] Int. Cl.[5] ..... A63B 53/04

[52] U.S. Cl. ..... 273/169; 273/172; 273/167 A

[58] Field of Search ..... 273/167 R, 167 A, 167 F, 273/167 J, 167, 169, 172, 173, 171, DIG. 5, DIG. 7, DIG. 12, DIG. 23; 264/241, 255, 259, 271.1, 328.18, 297.2; 428/308.4, 318.4

[56] References Cited

U.S. PATENT DOCUMENTS

| | | | |
|---|---|---|---|
| 3,955,820 | 5/1976 | Cochran et al. | 273/167 F |
| 4,498,673 | 2/1985 | Swanson | 273/171 |
| 4,667,963 | 5/1987 | Yoneyama | 273/169 |
| 4,728,105 | 3/1988 | Kobayashi | 273/169 |
| 4,793,616 | 12/1988 | Fernandez | 273/169 |
| 4,803,023 | 2/1989 | Enomoto et al. | 273/167 H |
| 4,824,116 | 4/1989 | Nagamoto et al. | 273/171 |
| 4,874,171 | 10/1989 | Ezaki et al. | 273/169 |
| 4,964,640 | 10/1990 | Nakanishi et al. | 273/173 |
| 5,009,425 | 4/1991 | Okumoto et al. | 273/169 |
| 5,016,882 | 5/1991 | Fujimura et al. | 273/169 |

*Primary Examiner*—V. Millin
*Assistant Examiner*—Steven Wong
*Attorney, Agent, or Firm*—Finnegan, Henderson, Farabow, Garrett & Dunner

[57] ABSTRACT

An iron golf club head having a sole and a hosel molded integrally as a frame from a metallic material, a core portion disposed in an upper part above the sole and the outer periphery of the core portion and the outer periphery of the frame except for the sole are covered with a fiber-reinforced resin and a weight having a greater specific gravity than the metallic material of the frame disposed between the sole and the core portion. The weight consists of a mass of 92 to 98 wt. % of powdery tungsten mixed in a polyamide resin.

11 Claims, 3 Drawing Sheets

IRON GOLF CLUB HEAD MADE OF FIBER-REINFORCED RESIN

This is a continuation-in-part application of U.S. patent application Ser. No. 07/571,146, filed Aug. 23, 1990, abandoned.

BACKGROUND OF THE INVENTION

1. Field of the Invention:

This invention relates to an iron golf club head made of a fiber-reinforced resin as its principal material, and more particularly, to an iron golf club head which can easily make centroid adjustment without changing the design of the outer shape of the club head.

2. Description of the Prior Art:

An iron golf club head made of a fiber-reinforced resin as its principal material in place of an iron golf club head made completely of a metal has been proposed as disclosed in Japanese patent application Kokai publication No. 61-249484 and in Japanese utility model application Kokai publication No. 61-154968. This iron golf club head made of the fiber-reinforced resin consists substantially of the fiber-reinforced resin or the like as its principal material except that its sole and hose are molded integrally from a metal.

Centroid adjustment is extremely important in a golf club head. If the centroid of the golf club head is moved to a lower position, for example, the fly-out angle of the hit ball can be increased and if it is moved to a rear part of the head, the sweet area can be enlarged. Conventionally, such centroid adjustment has been made by mixing metal particles in the fiber-reinforced resin or fitting a metallic plate to the back of the ball hitting face or increasing the width or thickness of the sole. However, centroid adjustment by such means involves the problem that its control is extremely difficult. In the case of a middle iron club or short iron club, there is also the problem that the centroid is likely to become higher because the weight distribution is not smooth and uniform and the design of a toe-heel balance for enlarging the sweet area is difficult. In the case of increasing the width and thickness of the sole, another problem is posed that the shape of the club head must be changed in addition to the problem described above.

SUMMARY OF THE INVENTION

It is therefore an object of the present invention to provide an iron golf club head made of a fiber-reinforced resin in which centroid adjustment can be easily made without the need of substantially changing the club head shape.

It is another object of the present invention to provide an iron golf club head made of a fiber-reinforced resin which can easily lower the centroid and can easily increase the centroid depth.

It is still another object of the present invention to provide an iron golf club head made of a fiber-reinforced resin which permits easy centroid design of iron golf clubs ranging from middle iron golf clubs to short iron golf clubs.

The iron golf club head made of a fiber-reinforced resin in accordance with the present invention has a known club head structure such that a sole and a hosel molded integrally as a frame from a metallic material, a core portion is disposed in an upper part above the sole and the outer periphery of the core portion and the outer periphery of the frame except for the sole are covered with a fiber-reinforced resin. However, in the club head according to the invention, a weight having a greater specific gravity than the metallic material of the frame is disposed at least over a part of the upper surface of the sole in a manner of being interposed between the sole and the core portion. Such a weight may consists of a mass of 92 to 98 wt. % of powdery tungsten mixed in a polyamide resin.

In greater detail, the weight is made of a composite material comprising a polyamide resin and powdery tungsten contained in the resin at a high content ratio, so that the weight can have a high specific gravity relative to its volume. That the weight is relatively small in volume but relatively high in specific gravity makes it possible to easily effect a centroid adjustment without the need of changing the design of the outer shape of club heads.

In addition, the weight is disposed on the upper surface of the sole and, moreover, independently of the other portions described above, so that the centroid of the club head can be easily adjusted merely by changing the position of the weight in the club head. Moreover, an adjustment to lower the centroid or deepen its position, too, can be made easily.

DETAILED DESCRIPTION OF THE PREFERRED EMBODIMENTS

Figure 1:
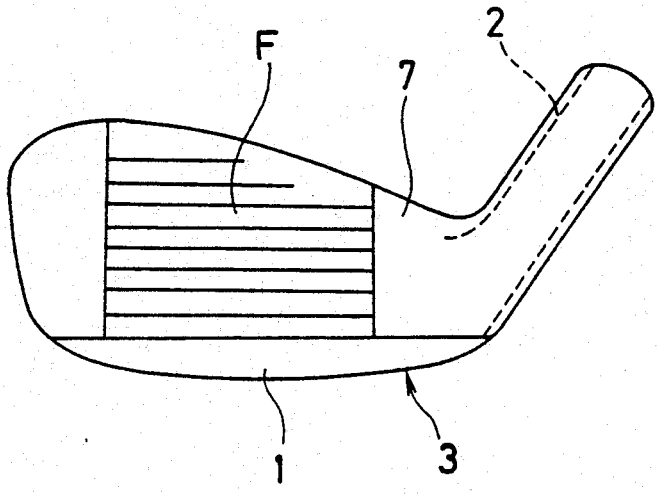
FIG. 1 is a front view of an iron golf club head made of a fiber-reinforced resin in accordance with an embodiment of the present invention.
Figure 2:
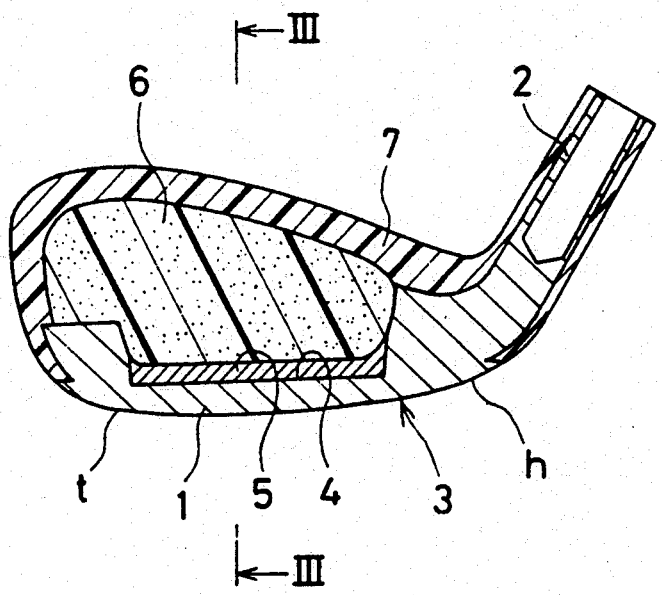
FIG. 2 is a longitudinal sectional view of the iron golf club head of FIG. 1.
Figure 3:
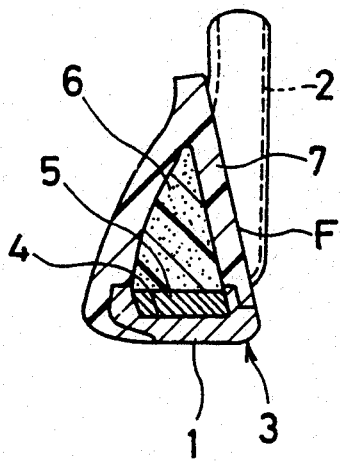
FIG. 3 is a sectional view taken along line III—III of FIG. 2.

In the iron golf club head made of a fiber-reinforced resin that is shown in FIGS. 1 to 3, the reference numeral 1 represents a sole and 2 a hosel for the connection of the club head to a club shaft. The sole 1 and the hosel 2 are molded integrally from a metallic material and together constitute a frame 3. Stainless steel is preferably used as the metallic material for forming this frame 3. A fitting recess 4 is formed on the upper surface of the sole 1 and a weight 5 is buried in this recess 4. Furthermore, a core portion 6 is disposed above the sole 1 in contact with the upper surface of the weight 5 and a fiber-reinforced resin 7 covers its outer surface. This fiber-reinforced resin 7 covers not only the surface of the core portion 6 but also the outer surface of the frame 3 other than the portion of the sole 1. A ball hitting face F is formed on the front surface of the head covered with the fiber-reinforced resin 7.

The weight 5 is made of a composite comprising a polyamide resin and powdery tungsten contained in the resin at a high content ratio. The content ratio of the tungsten powder to the polyamide resin is set so high as to be 92 to 98 wt. % or, more preferably, 95 to 97 wt. %. Tungsten has such a largely higher specific gravity as to be 19.3 than other metals, so that the composite having a high content ratio of tungsten as above can have a high specific gravity relative to its volume which is relatively limited. The weight 5 made of such composite has a relatively limited volume but a relatively high specific gravity, and as a result of this, according to the present invention it is possible to easily adjust the centroid of a club head without changing the design of the outer shape of the club head.

When the content ratio of powdery tungsten in the resin is less than 92 wt. %, the specific gravity of the resulting composite falls below about 8.5, and in this case, the function of the composite a weight lowers. On the other hand, if the content ratio is more than 98 wt. %, the moldability of the composite tends to be adversely affected, the dimensional accuracy of the weight configuration after molding tends to lower, and possibly the ease of the centroid adjustment may eventually become lost or lowered.

The polyamide resin used as the matrix of the above described composite not only imparts a moldability to the powdery tungsten but also maintains the tungsten powder in a fixed state in a molded composite. If a weight made of such a material as tungsten powder is not made a composite together with the polyamide resin, but remains in the form of powder particles, when an impact is applied to the club head, the powder particles tends to undergo mutual movement which results in a change in the center of gravity of the club head.

Polyamide resins have excellent affinity with tungsten powder when compared with other resins, so that it is possible not only to make a polyamide resin containing tungsten powder at such a high content ratio as 92 wt. % or more, but also to disperse the tungsten powder with a uniform density distribution in the matrix. Thus, an adjustment of the specific gravity of the composite can be easily effected, whereby an adjustment of the position of the center of gravity in the club head can be made with ease. Also, polyamide resins exceed other resins with respect to stiffness, bending modulus and impact strength, so that by using a polyamide resin for the composite for the weight, the remarkable characteristics of the resin having to do with stiffness, bending modulus and impact strength can be imparted to the weight. Consequently even after the club head is subjected to repeated applications of impact, it does not undergo a change in the position of the center of gravity or in the outer shape of the weight, whereby it can maintain its initial performance characteristics over a long period of time.

For the polyamide resin used in the present invention, while either of nylon 6 or nylon 66 is useful, particularly nylon 6 is desirable. To attain a desirable dispersibility of the tungsten powder in the polyamide resin, preferably the tungsten powder should have an average particle diameter of 50 μm or below. More preferably, the tungsten powder should have such a particle diameter distribution in which powder particles having a diameter of 10 μm or below occupies at least 50 wt. %. Further, the composite may preferably contain as a dispersant 0.01 to 0.5 wt. % of a saturated aliphatic carboxylic acid compound, and more preferably, further contain 0.1 to 0.5 wt. % of an acrylic ester copolymer.

To dispose the weight 5 on the upper surface of the sole 1, it is advisable to form the recess 4 in the upper surface of the sole and then to bury the weight 5 in this recess. In this manner, the weight can be disposed at a position as low as possible and a lower centroid design can be accomplished easily.

The core portion 6 is made of a material having a relatively low specific gravity and a syntactic foam, a bulk molding compound (BMC), sheet molding compound (SMC), or the like, is used preferably. A polyamide resin or polycarbonate resin or ABS resin having a high hardness may be used as the material for this core portion 6. A thermo-setting resin such as an epoxy resin, an unsaturated polyester resin, or the like, is used as the resin of the fiber-reinforced resin 7 and a carbon fiber, a glass fiber, an aromatic polyamide fiber, whiskers, or the like, is used as the reinforcing fiber.

Figure 4A:
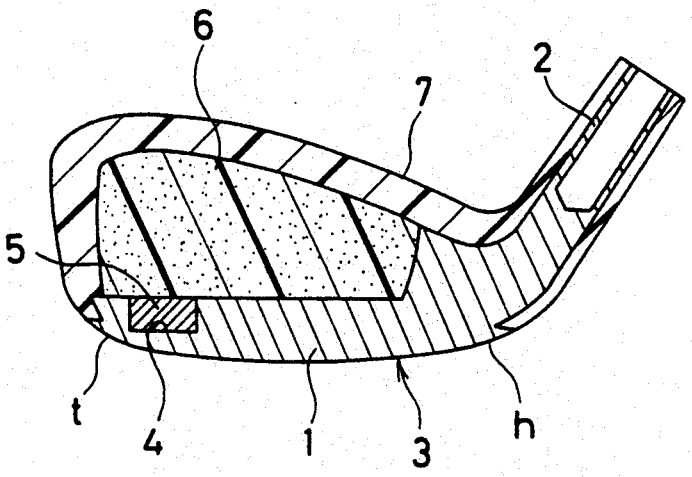
FIGS. 4A and 4B are longitudinal sectional views similar to FIG. 2, of iron golf club heads made of a fiber-reinforced resin in accordance with other embodiments of the invention.
Figure 4B:
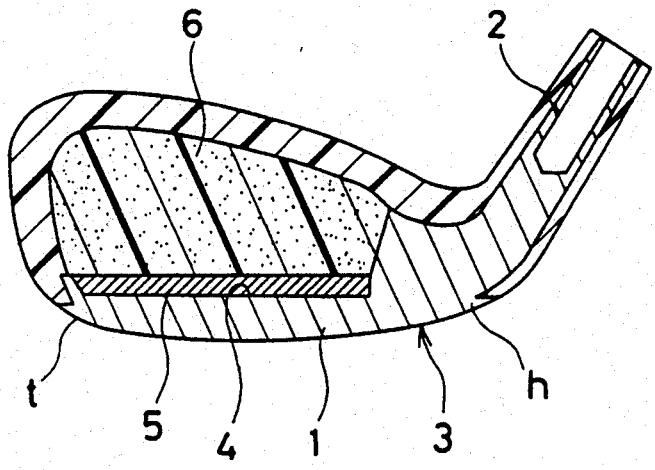
Figure 5A:
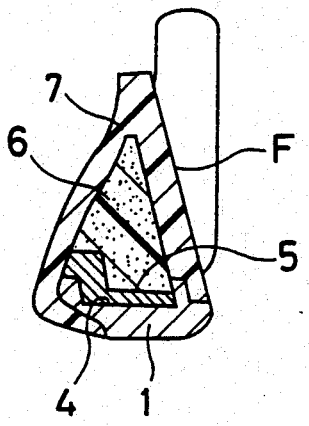
FIGS. 5A to 5E are sectional views similar to FIG. 3, of iron golf club heads made of a fiber-reinforced resin according to other embodiments of the invention.
Figure 5B:
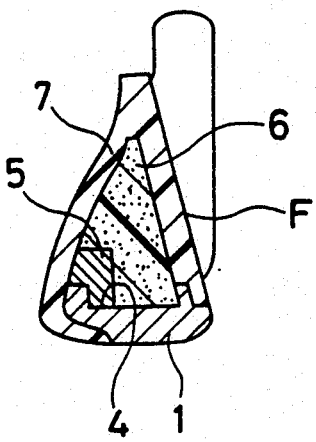
Figure 5C:
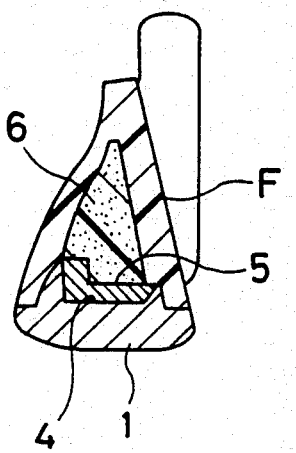
Figure 5D:
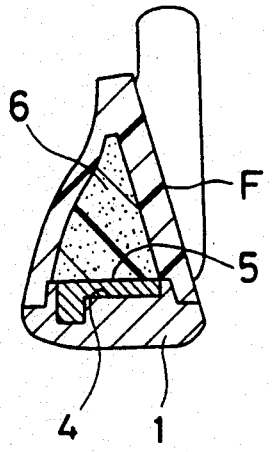
Figure 5E:
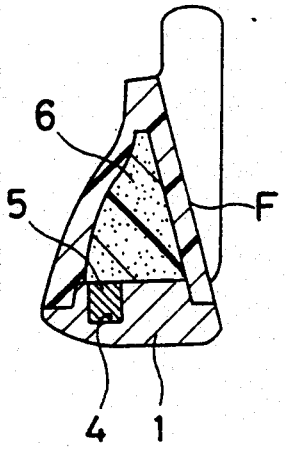

In the iron golf club head of the present invention described above, the weight 5 is an independent or a separate member. Accordingly, its position on the upper surface of the sole 1 can be changed arbitrarily, so that the adjustment of the centroid can be made easily. For example, it is possible to displace the weight 5 towards the side of the toe t as shown in FIG. 4A or to dispose the weight 5 so as to extend substantially throughout the entire surface from the toe t to the heel h as shown in FIG. 4B. This allows an adjustment of the toe-heel balance to be made easily. The depth of the centroid can be increased by making the weight 5 in an L-letter sectional shape and displacing its weight distribution to the opposite side of the face F on the upper surface of the sole, that is, towards the rear part of the club head, as shown in FIGS. 5A, 5C and 5D. The above can also be accomplished by shaping the weight 5 in a block-like sectional shape and disposing it only at the rear part of the head as shown in FIGS. 5B and 5E. Furthermore, if the weight 5 is displaced towards the toe side t as shown in FIG. 4A, the sweet area will be enlarged.

As described above, in the iron golf club head in accordance with the present invention, lowering and deepening of the centroid and adjustment of the toe-heel balance can be made freely without having to change the shape of the club head. Accordingly, structural design of the golf clubs, particularly those ranging from the middle iron clubs to the short iron clubs, can be made easily.

Figure 6:
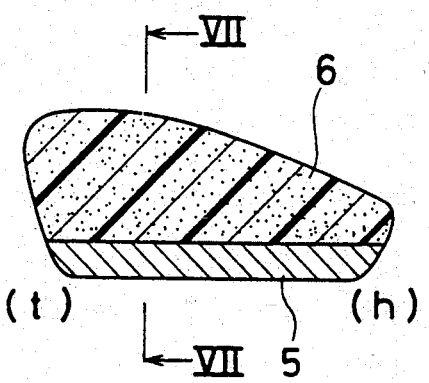
FIG. 6 is a longitudinal sectional view of the composite structure of a core portion and a weight for use in an iron golf club head made of a fiber-reinforced resin in still another embodiment of the invention.
Figure 7:
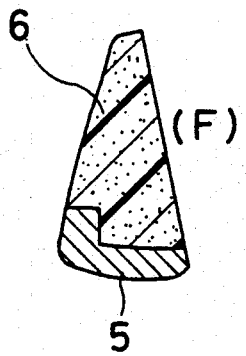
FIG. 7 is a sectional view taken along line VII—VII of FIG. 6.
Figure 8:
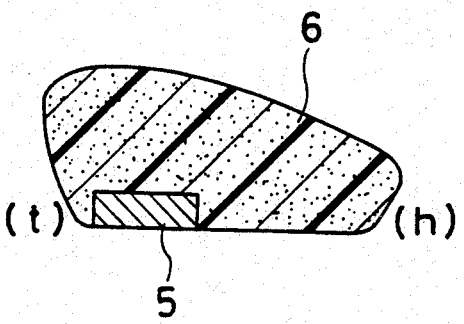
FIG. 8 is a longitudinal sectional view of the composite structure of a core portion and a weight for use in an iron golf club head made of a fiber-reinforced resin in still another embodiment of the invention.
Figure 9:
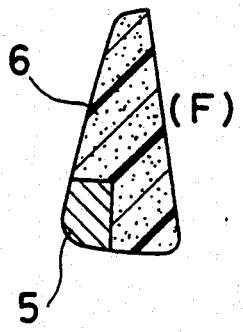
FIG. 9 is a longitudinal sectional view similar to FIG. 7, of the composite structure of a core portion and a weight according to still another embodiment of the invention.

When the weight 5 is made of a composite material comprising a polyamide resin and powdery tungsten mixed in the resin, a composite structure such as shown in FIGS. 6 and 7 can be obtained by injection-molding the composite material with the core portion 6 or by bonding them to each other. If such a composite structure is employed, the control of the centroid position can be easily made. In this composite structure, it is possible to displace the weight towards the toe side as shown in FIG. 8 or towards the rear part of the head as shown in FIG. 9. In this manner, the toe-heel balance adjustment and the sweet area expansion adjustment can be made easily.

What is claimed is:

1. An iron golf club head made of a fiber-reinforced resin, comprising:

a frame having a sole portion and a hosel portion molded integrally from stainless steel, said sole portion having a recess formed in its upper surface;

a core portion disposed above the upper surface of said sole portion of said frame;

a separate weight comprising a molded composite of from 92 to 98% by weight of powdery tungsten and a polyamide resin, said weight being disposed in said recess in said sole portion between the sole portion and said core portion, said weight having a specific gravity greater than that of the stainless steel of said frame; and a fiber-reinforced resin covering the outer periphery of said core portion and the outer periphery of said frame other than said sole portion.

2. The iron golf club head of claim 1, wherein the powdery tungsten of said composite has an average particle diameter of 50 μm or less.

3. The iron golf club head of claim 2, wherein the particle diameter of at least 50% by weight of the powdery tungsten based on the total weight of said tungsten is 10 μm or less.

4. The iron golf club head of claim 1, wherein said polyamide resin in said composite is nylon 6 or nylon 66.

5. The iron golf club head of claim 4, wherein said polyamide resin in said composite is nylon 6.

6. The iron golf club head of claim 1, wherein said composite contains a saturated aliphatic carboxylic acid compound.

7. The iron golf club head of claim 1, wherein said composite contains a saturated aliphatic carboxylic acid compound and an acrylic acid ester copolymer.

8. The iron golf club head of claim 1, wherein said club head has a toe side remote from the hosel portion and wherein the recess is located in said sole portion so that said weight is disposed towards the toe side of said golf club head.

9. The iron golf club head of claim 1, wherein said club head has a front face and a rear part opposite therefrom, said recess being located in said sole portion so that said weight is disposed towards the rear part of said golf club head.

10. The iron golf club head of claim 1, wherein said weight is bonded to said core portion.

11. The iron golf club head of claim 1, wherein said fiber-reinforced resin is a carbon fiber-reinforced resin.

* * * * *